US006158352A

United States Patent [19]

Theurer et al.

[11] Patent Number: 6,158,352

[45] Date of Patent: Dec. 12, 2000

[54] MACHINE AND METHOD FOR REHABILITATING A TRACK

[75] Inventors: Josef Theurer, Vienna; Bernhard Lichtberger, Leonding, both of Austria

[73] Assignee: Franz Plasser Bahnbaumaschinen-Industriegesellschaft m.b.H., Vienna, Austria

[21] Appl. No.: 09/152,833

[22] Filed: Sep. 14, 1998

[30] Foreign Application Priority Data

Oct. 6, 1997 [AT] Austria ..... 1687/97

[51] Int. Cl.[7] ..... E01B 29/04

[52] U.S. Cl. ..... 104/7.2; 104/6; 104/7.3; 104/8; 33/287

[58] Field of Search ..... 104/2, 12, 6, 7.3, 104/8, 7.2; 33/1 Q, 287, 333, 334, 338, 651, 651.1

[56] References Cited

U.S. PATENT DOCUMENTS

| | | | |
|---|---|---|---|
| 3,795,056 | 3/1974 | Plasser et al. | 33/287 |
| 4,031,625 | 6/1977 | Theurer | 33/1 Q |
| 4,166,291 | 8/1979 | Shupe | 33/287 |
| 4,341,160 | 7/1982 | Nielsen | 104/8 |
| 4,574,704 | 3/1986 | Cicin-Sain | 104/8 |
| 4,658,730 | 4/1987 | von Beckmann et al. | 104/8 |
| 5,012,413 | 4/1991 | Sroka et al. | 33/1 Q |
| 5,203,089 | 4/1993 | Trefouel et al. | 33/287 |
| 5,481,982 | 1/1996 | Theurer et al. | 104/7.2 |
| 6,014,815 | 1/2000 | Jager | 33/287 |

FOREIGN PATENT DOCUMENTS

| | | |
|---|---|---|
| 16295 | 7/1986 | Austria . |
| 2268529 | 2/1995 | United Kingdom . |
| 2268021 | 1/1996 | United Kingdom . |

*Primary Examiner*—S. Joseph Morano
*Assistant Examiner*—Lars A. Olson
*Attorney, Agent, or Firm*—Horst M. Kasper

[57] ABSTRACT

A mobile machine for rehabilitating a track has a machine frame extending in a longitudinal direction and supported by undercarriages for mobility on the track in an operating direction, the machine frame being composed of a leading frame part with respect to the operating direction and a trailing frame part connected to the leading frame part by an articulation, with at least one working unit being mounted on the machine frame for adjustment relative thereto. A reference system for controlling the position of the working unit is arranged on the leading frame part and consists of a reference line extending in the longitudinal direction between two of said undercarriages, a measuring axle designed to roll on the track, and a measuring device connected to the measuring axle for detecting a movement, transversely to the longitudinal direction, of the measuring axle relative to the reference line. An angle-measuring device is provided for detecting an actual frame angle enclosed by the leading and the trailing frame part.

6 Claims, 2 Drawing Sheets

MACHINE AND METHOD FOR REHABILITATING A TRACK

BACKGROUND OF THE INVENTION

1. Field of the Invention

The present invention relates to a mobile machine for rehabilitating a track extending in a longitudinal direction, comprising a machine frame extending in the longitudinal direction and supported by undercarriages for mobility on the track in an operating direction, the machine frame being composed of a leading frame part with respect to the operating direction and a trailing frame part connected to the leading frame part by an articulation, at least one working unit mounted on the machine frame for adjustment relative thereto, and a reference system for controlling the position of the working unit.

This invention also relates to a method for restoring a position of a track.

2. Description of the Prior Art

A ballast cleaning machine composed of two frame parts which are articulatedly connected to one another is known from GB 2,268,021. A laser reference system serves for detecting the longitudinal inclination of the track in the region of the forward, leading frame part in order to be able to control, in accordance with said measurement, the vertical position of working units located on the trailing frame part. To that end, a laser transmitter is provided which is permanently kept in a horizontal position. Arranged on the front undercarriage of the leading frame part is a laser receiver which serves for detecting the longitudinal inclination of the leading frame part with reference to the horizontal laser reference plane. A longitudinal inclination value is computed via an algorithm and is then conveyed in a time-delayed manner to a further laser receiver, located on a clearing chain on the trailing frame part, in order to thereby be able to control the vertical position of the clearing chain.

Additionally known from GB 2,268,529 is a ballast cleaning machine in which respective longitudinal and transverse inclination meters are fastened to a leading as well as to a trailing frame part. The longitudinal inclination of the track is measured in the region of the leading frame part and stored as a target value which is passed on in a time-delayed manner for controlling the vertical position of a clearing chain. In this, the actual or existing inclination detected by the longitudinal inclination meter of the trailing frame part must be taken into account. For the purpose of controlling the vertical position of the clearing chain, a cable potentiometer is provided which is arranged between the trailing frame part and the clearing chain.

SUMMARY OF THE INVENTION

It is the primary object of this invention to improve a mobile machine of the first-described type in such a manner that it becomes possible to restore the original or actual position of the track, having been destroyed by the action of working units arranged on the machine, relatively accurately and without difficulty while using simple means.

In a mobile machine of the first-described type, the above and other objects and advantages are accomplished according to the invention by designing the reference system, arranged on the leading frame part, to consist of a reference line extending in the longitudinal direction between two of said undercarriages, a measuring axle designed to roll on the track, and a measuring device connected to the measuring axle for detecting a movement, transversely to the longitudinal direction, of the measuring axle relative to the reference line, and by providing an angle-measuring device for detecting an actual frame angle enclosed by the leading and the trailing frame part.

This novel arrangement, while requiring relatively little effort and structural expense, creates the possibility to survey the existing, actual position of the track immediately before the destruction thereof and to reproduce said measured actual track position via the angular relationship of the trailing frame part with respect to the leading frame part, permanently situated in the actual track position, for the purpose of controlling the working units. In the process, use is made of the realization that the theoretical target position of the trailing frame part may be computed easily in a locus which is to be formed from the measured track values and corresponds to the actual track position. Since the actual position of the trailing frame part also can be found via the angle-measuring device, the displacement values required for controlling the working units may be computed very easily and dependably by subtraction of measurement values.

According to another aspect of the present invention, there is provided a method for restoring a position of a track immediately after said position has been destroyed by the action of working units arranged on a machine frame of a machine mobile on the track on undercarriages, the machine frame comprising, with respect to an operating direction, a leading and a trailing frame part joined by an articulation, the working units being mounted on the trailing frame part, the method comprising the steps of: detecting an actual track position by continuously measuring versines and/or an inclination of the track with respect to the longitudinal direction thereof in the region of the leading frame part, thereby establishing measuring values defining the lateral and/or vertical track position; computing on the basis of said measuring values a locus corresponding to the actual track position and tied to a distance-based coordinate system; matching the machine frame by calculation to the locus in three points, namely at the articulation and at the two undercarriages adjoining the same, thereby finding the theoretical target position of the trailing frame part with respect to the locus; computing a target frame angle enclosed by the theoretical target position of the trailing frame part and the leading frame part; computing the actual position of the trailing frame part with respect to the locus, based on the actual frame angle; determining a control value for the working unit by forming the difference between the theoretical and actual position of the trailing frame part; and actuating a drive for displacing the working unit relative to the trailing frame part in accordance with the said control value.

This method according to the invention makes it possible in an advantageous manner to carry out a continuous survey of the actual track position in the course of working operations taking place during continuous forward travel of the machine, in order to reproduce said track position in a simple way with the aid of the positions of the machine frame. Thus, the track can be lowered again into the original position in a relatively simple manner right after operation of the working units while avoiding time-consuming additional correcting procedures.

BRIEF DESCRIPTION OF THE DRAWING

The above and other objects, advantages and features of the present invention will be described hereinafter in detail in connection with two now preferred embodiments thereof, taken in conjunction with the accompanying schematic drawing wherein.

DETAILED DESCRIPTION OF THE PREFERRED EMBODIMENTS

Figure 1:
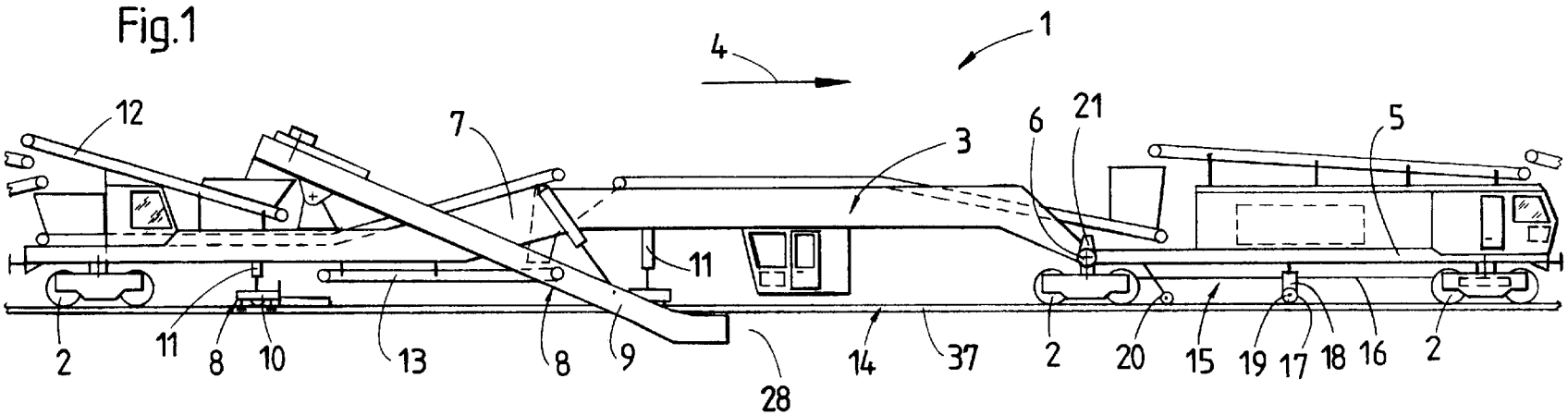
FIG. 1 is a side elevational view of a track working machine for cleaning a ballast bed, having a reference system for measuring lateral track position faults and for controlling working units.

Throughout all the Figures, the same or corresponding elements are always indicated by the same reference numerals.

Referring now to the drawing and first to FIG. 1, there is shown a mobile machine 1 for cleaning ballast of a ballast bed 28 supporting a track 14 having two rails 37 extending in a longitudinal direction. The machine has a machine frame 3 which is supported by undercarriages 2 for mobility on the track 14 in an operating direction indicated by arrow 4. The machine frame 3 is composed of a frame part 5, leading with respect to the operating direction, and a trailing frame part 7 which is connected to the leading frame part by means of an articulation 6. Arranged on the trailing frame part 7 are working units 8 in the shape of a clearing chain 9 and a track lifting device 10 which are adjustable relative to the trailing frame part 7 by means of drives 11. The ballast taken up from the ballast bed 28 by the endless clearing chain 9 is transported via a conveyor belt 12 of a screening installation (not shown for reasons of clarity) to a screening car coupled to the trailing frame part 7. After having been cleaned, the ballast is discharged via a conveyor belt arrangement 13 upon the track 14, or upon an exposed earth formation thereof, to restore the ballast bed 28.

Located on the leading frame part 5 is a reference system 15 for detecting lateral faults in the actual track position. Said reference system is composed of a reference line 16, a measuring axle 17 and a measuring device 18. The reference line 16 is formed by a steel chord extending in the longitudinal direction and arranged centrally with respect to a direction extending transversely of the track. The measuring device 18 is connected to the measuring axle 17 and consists of a linear potentiometer, displaceable transversely to the longitudinal direction, for detecting a displacement of the measuring axle 17 relative to the reference line 16. The measuring axle 17 is fastened to the leading frame part 5 and designed to roll on the track 14 by means of flanged rollers 19 which are pressed against one of the rails 37 of the track 14 transversely to the longitudinal direction by means of a drive (not shown). In this way the measuring axle 17 is able to accurately follow the lateral course of the track while any gauge play is eliminated. An odometer 20 is provided for detecting the distance travelled by the machine 1.

An angle-measuring device 21 is arranged in the region of the articulation 6 for detecting an actual or existing frame angle $\beta$ (see FIG. 2) enclosed by the two frame parts 5,7 with regard to a horizontal plane extending parallel to a plane defined by points of support of the undercarriages 2 on the rails 37. If, in addition to detecting the lateral track position, one wishes to also register the vertical position of the track, it is necessary to provide a second angle-measuring device 21 for detecting a vertical angle enclosed by the two frame parts 5 and 7 with respect to a vertical plane.

Figures 2, 4:
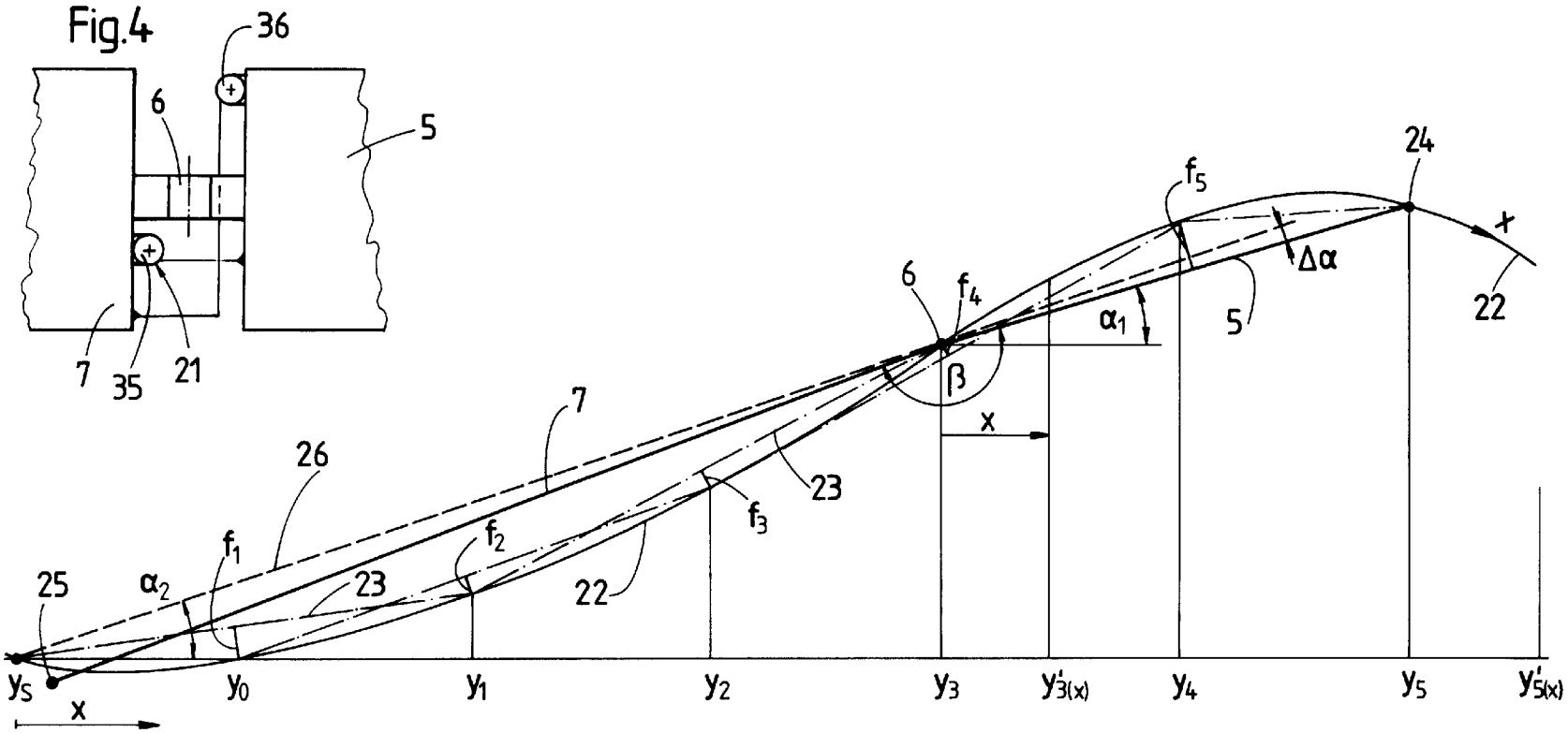
FIG. 2 shows a coordinate system with a locus formed by versine measurements.
FIG. 4 is a schematic representation of an angle-measuring device.

Turning now to FIG. 2, there is shown a coordinate system, the x-axis of which represents the track distance x as registered by the odometer 20 of the machine 1, while the y-axis shows the lateral positional deviations (lining faults) in a locus 22 representing the actual track position. From the versines f, as measured by the measuring device 18 of the reference system 15 at the leading frame part 5, it is possible to approximate the said locus 22 of the track 14 in connection with a polygonal curve 23 shown in dash-dotted lines.

The bogie pivot distance between the two front undercarriages 2 supporting the leading frame part 5 is 12 meters. The measuring axle 17 is located centrally between said two undercarriages 2. Therefore, measurement of the versines is carried out at intervals of 6 meters (resulting in a polygonal length of 6 meters). The bogie pivot distance between the two rear undercarriages 2 supporting the trailing frame part 7 is 24 meters, which greatly simplifies the developing of corresponding mathematical formulas for determining the control values for the working units 8.

Prior to starting working operations, a length of track corresponding to one machine length (that is 36 meters) leading up to the work site should be surveyed, so that a locus 22 (FIG. 2) is already available from the five resulting versines f. Due to the geometry mentioned, the articulation 6 of the two frame parts 5,7 is positioned exactly at $y_3$ in the locus 22. A front bogie pivot 24 of the machine frame 3 is positioned at $y_5$. A rear bogie pivot of the trailing frame part 7 is denoted by the numeral 25. The actual frame angle enclosed by the two frame parts 5,7 and detected by the angle-measuring device 21 is indicated by the character $\beta$, while $\alpha_2$ indicates the desired or target frame angle enclosed by the theoretical target position of the trailing frame part 7 and the leading frame part 5 and given in the form of a pitch ($k_2$).

As shown in FIG. 2, versines $f_1$, $f_2$l , $f_3$ . . . are continuously registered at 6-meter-intervals with the aid of the reference system 15 during working forward travel of the machine 1. As soon as a total of five versines f are known within the space of the machine frame 3, the locus 22 can be approximated based on the polygonal curve 23. The position of the machine 1 is now superimposed by calculation onto said locus 22, the articulation 6 being located precisely at $y_3$. Since the leading frame part 5 is always situated at the actual track position, the articulation 6 as well as the front bogie pivot 24 are positioned on the locus 22. The length of the trailing frame part 7 is also a known dimension. From these given data, the theoretical target position (indicated by dashed line 26) of the trailing frame part 7 may be computed quite easily. In this position, the rear bogie pivot 25 must lie on the locus 22.

On the basis of the theoretical target position of the trailing frame part 7 it is possible to determine the target frame angle $\Delta\alpha$ enclosed with the leading frame part 5, appropriately specified in the form of a pitch (k). The actual frame angle $\beta$ determined by the angle-measuring device 21 is also to be specified appropriately in the form of a pitch $\Delta y/\Delta x$. The deviation or positional fault of the trailing frame part 7 with respect to the theoretical target position may be specified by subtraction between the actual frame angle $\beta$ and the target frame angle $\Delta\alpha$ or the actual and target pitch ($k_1$, $k_2$) of the trailing frame part 7. The lateral deviation from the target position, for instance at the rear bogie pivot 25, is then simply found by multiplying the pitch difference with the length of the machine. Corresponding actuation of the drive 11 results in a consolidation relative to the trailing frame part 7 until the working unit 8 is positioned in the target position (corresponding to the actual position as it was present before the operation of the working units 8) for restoring the actual track position surveyed at the leading frame part 5.

The formula for calculation will now be explained in more detail.

For the y-values of the locus 22, the following formulas apply:

$$y_1=2\cdot f_1$$

$$y_2=2\cdot(2f_1+f_2)$$

$$y_3=2\cdot(3f_1+2f_2+f_3)$$

$$y_4=2\cdot(4f_1+3f_2+2f_3+f_4)$$

$$y_5=2\cdot(5f_1+4f_2+3f_3+2f_4+f_5)$$

For the pitch difference $\Delta k=\Delta y/\Delta x$, the following formulas apply (precisely when a new versine is measured at 6 meters):

$$\Delta k(\Delta\alpha)=k_2(\alpha_2)-k_1(\alpha_1)=\frac{y_3}{2s}-\frac{y_5-y_3}{s}=\frac{3y_3-2y_5}{2s}$$

in which s=length of leading frame part 5, 2s=length of trailing frame part 7.

During travel between two measured versines f, the following formulas are used for interpolation (x=distance, from 0 to 6 meters respectively):

$$y_3'=y_3+2x\cdot\frac{y_4-y_3}{s}$$

$$y_5'=2(5f_1+4f_2+3f_3+2f_4+f_5'(x))$$

$$\Delta k=\frac{3y_3'-2y_5'}{2s}$$

In order to obtain uniform pitch results independent of units, the versines, chords and the location must be entered in the computation formulas using the same unit, for example meters.

Figure 3:
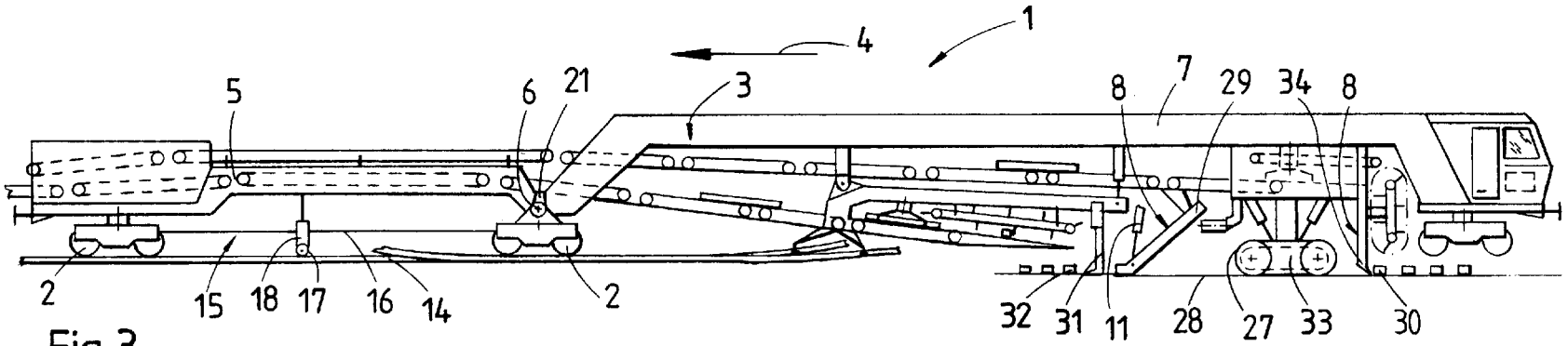
FIG. 3 is a side elevational view of another embodiment of a track working machine suitable for track renewal.

Turning now to FIG. 3, there is shown a further embodiment of a machine 1 which is suited for track renewal. As in the previous example, the machine frame 3 is in two parts, with a leading frame part 5 being connected to a trailing frame part 7 by means of an articulation 6. The leading frame part 5 is equipped with a reference system 15, a reference line 16 and a measuring axle 17 for detecting the lateral position of a track 14. An angle-measuring device 21 is provided at the articulation 6. The rear end of the trailing frame part 7 is supported on a graded ballast bed 28 via a caterpillar-tracked undercarriage 27. Working units 8 are provided in the shape of a vertically and transversely adjustable grading device 29 and a device 34 for laying new sleepers 30. A further device 31 serves for taking up old sleepers 32.

For the purpose of restoring the track position, it is also a possibility to actuate drives 33, serving to steer the caterpillar-tracked undercarriage 27, in dependence upon a control value determined with the aid of the reference system 15 and the angle-measuring device 21, since, along with steering the caterpillar-tracked undercarriage 27, the working units 8 are automatically centered also.

FIG. 4 shows schematically and in enlarged detail an angle-measuring device 21 which comprises a cable potentiometer 35 arranged in the region of the articulation 6 and connected with both frame parts 5 and 7. In this way, an actual frame angle (β) enclosed with a horizontal plane is detected. A cable potentiometer 36, which extends in the vertical direction and connects the two frame parts 5,7 to one another, is provided for detecting the twist of the two frame parts 5,7 with regard to one another.

As a variant, the reference line 16 could, of course, also be shaped as a laser beam. Also, instead of an articulation 6, a regular wagon coupling could be used to connect the two frame parts 5 and 7 to one another.

What is claimed is:

1. A mobile machine for rehabilitating a track extending in a longitudinal direction, comprising (a) a machine frame extending in the longitudinal direction and supported by at least three sequentially disposed undercarriages for mobility on the track in an operating direction, the machine frame being composed of (1) a leading frame part with respect to the operating direction and (2) a trailing frame part connected to the leading frame part by an articulation, (b) at least one working unit mounted on the machine frame for adjustment relative thereto, (c) a reference system for controlling the position of the working unit, the reference system being arranged on the leading frame part and consisting of (1) a reference line extending in the longitudinal direction between two neighboring ones of said undercarriages, (2) a measuring axle designed to roll on the track, and (3) a measuring device connected to the measuring axle for detecting a movement, transversely to the longitudinal direction, of the measuring axle relative to the reference line, and (d) an angle-measuring device for detecting an actual frame angle enclosed by the leading and the trailing frame part, wherein the angle measuring device is formed by a cable potentiometer, arranged in the region of the articulation and connected to the leading and the trailing frame part, for detecting the actual frame angle enclosed with reference to a horizontal plane.

2. The machine of claim 1, further comprising a second cable potentiometer associated with the angle-measuring device and linking the leading and the trailing frame part to one another in the vertical direction for detecting any twist between the two frame parts.

3. A method for restoring a position of a track immediately after said position has been destroyed by the action of working units arranged on a machine frame of a machine mobile on the track on undercarriages, the machine frame comprising, with respect to an operating direction, a leading and a trailing frame part joined by an articulation, the working units being mounted on the trailing frame part, the method comprising the steps of:

(a) detecting an actual track position by continuously measuring versines and/or an inclination of the track with respect to the longitudinal direction thereof in the region of the leading frame part, thereby establishing measuring values defining the lateral and/or vertical track position;

(b) computing on the basis of said measuring values a locus corresponding to the actual track position and tied to a distance-based coordinate system;

(c) matching the machine frame by calculation to the locus in three points, namely at the articulation and at the two undercarriages adjoining the same, thereby finding the theoretical target position of the trailing frame part with respect to the locus;

(d) computing a target frame angle enclosed by the theoretical target position of the trailing frame part and the leading frame part;

(e) computing the actual position of the trailing frame part with respect to the locus, based on the actual frame angle;

(f) determining a control value for the working unit by forming the difference between the theoretical and actual position of the trailing frame part; and (g) actuating a drive for displacing the working unit relative to the trailing frame part in accordance with the said control values arranging a reference system being the leading frame part, wherein the reference system comprises a reference line extending in the longitudinal direction on the leading frame part, a measuring axle attached to the leading frame part and constructed to roll on the track, a measuring device connected to the measuring axle for detecting a movement, transversely to the longitudinal direction, of the measuring axle relative to the reference line, and an angle-measuring device formed by a cable potentiometer, arranged in the region of the articulation and connected to the leading and the trailing frame part, for detecting an actual frame angle enclosed by the leading and the trailing frame part;

detecting an actual frame angle enclosed by the leading and the trailing frame part with the cable potentiometer;

controlling the position of the working unit with the reference system.

4. A mobile machine for rehabilitating a track extending in a longitudinal direction, comprising (a) a machine frame extending in the longitudinal direction and supported by at least three undercarriages for mobility on the track in an operating direction, the machine frame being composed of (1) a leading frame part with respect to the operating direction and (2) a trailing frame part connected to the leading frame part by an articulation, (b) at least one working unit mounted on the machine frame for adjustment relative thereto, (c) a reference system for controlling the position of the working unit, the reference system being arranged on the leading frame part and consisting of (1) a steel chord furnishing a reference line extending in the longitudinal direction on the leading frame part, (2) a measuring axle designed to roll on the track and disposed on the leading frame part, and (3) a measuring device connected to the measuring axle for detecting a movement, transversely to the longitudinal direction, of the measuring axle relative to the steel chord, and (d) an angle-measuring device for detecting an actual frame angle enclosed by the leading and the trailing frame part, wherein the angle measuring device is formed by a cable potentiometer, arranged in the region of the articulation and connected to the leading and the trailing frame part, for detecting the actual frame angle enclosed with reference to a horizontal plane.

5. The machine of claim 4, further comprising a second cable potentiometer associated with the angle measuring device and linking the leading and the trailing frame part to one another in the vertical direction for detecting any twist between the two frame parts.

6. The method for restoring a position of a track according to claim 3 further comprising furnishing a second cable potentiometer associated with the angle measuring device;

linking the leading and the trailing frame part to one another in the vertical direction for detecting any twist between the two frame parts.

* * * * *